United States Patent [19]

Freeman et al.

[11] Patent Number: 4,633,626

[45] Date of Patent: Jan. 6, 1987

[54] KNOCK-DOWN EXTENDIBLE SHELTER

[75] Inventors: Richard B. Freeman, Wilmington, Del.; Walter S. Eggert, Jr., Huntington Valley, Pa.

[73] Assignee: The Budd Company, Troy, Mich.

[21] Appl. No.: 677,627

[22] Filed: Dec. 3, 1984

[51] Int. Cl.[4] ..... E04H 1/12

[52] U.S. Cl. ..... 52/71; 52/69; 52/79.5; 52/90; 52/126.6

[58] Field of Search ..... 52/64, 66, 67, 68, 69, 52/70, 71, 79.1, 79.5, 79.6, 79, 12, 90, 234, 126.6, 126.1, 126.5

[56] References Cited

U.S. PATENT DOCUMENTS

| | | | |
|---|---|---|---|
| 1,082,937 | 12/1913 | Douglass | 52/90 |
| 2,592,610 | 4/1952 | Shumaker | 52/69 |
| 2,751,635 | 6/1956 | Donnahue | 52/69 |
| 2,765,498 | 10/1956 | Kelnhofer | 52/71 X |
| 2,828,842 | 4/1958 | Plumley et al. | 52/79.5 X |
| 3,012,291 | 12/1961 | Rice | 52/69 |
| 3,093,259 | 6/1963 | Morrison | 52/64 X |
| 3,500,596 | 3/1970 | Andersson | 52/90 X |
| 3,984,948 | 10/1976 | Bussard | 52/69 |
| 4,167,838 | 9/1979 | Metheny | 52/90 X |

FOREIGN PATENT DOCUMENTS

| | | | |
|---|---|---|---|
| 331272 | 10/1935 | Italy | 52/71 |

OTHER PUBLICATIONS

*The Architectural Forum*, "Barracks for Shipment", pp. 91–95.

*Primary Examiner*—William F. Pate, III
*Assistant Examiner*—Richard Chilcot
*Attorney, Agent, or Firm*—Edward M. Farrell; Herman Foster; T. I. Davenport

[57] ABSTRACT

A knock-down extendible shelter structure is formed by a plurality of hingeable panels of wall, floor, and roof panels. Hinges are used to join the panels. The edges of the latches are used to fix them in place. A plurality of units including similar parts are adapted to be connected together to assemble a shelter of any size. The shelter is designed to be essentially a permanent building that can be readily dismantled and stored.

6 Claims, 22 Drawing Figures

13
26
28
35
34
37
22
20
30
32
38

12
24
33
36
15
11
18
16
14

FIG. 16
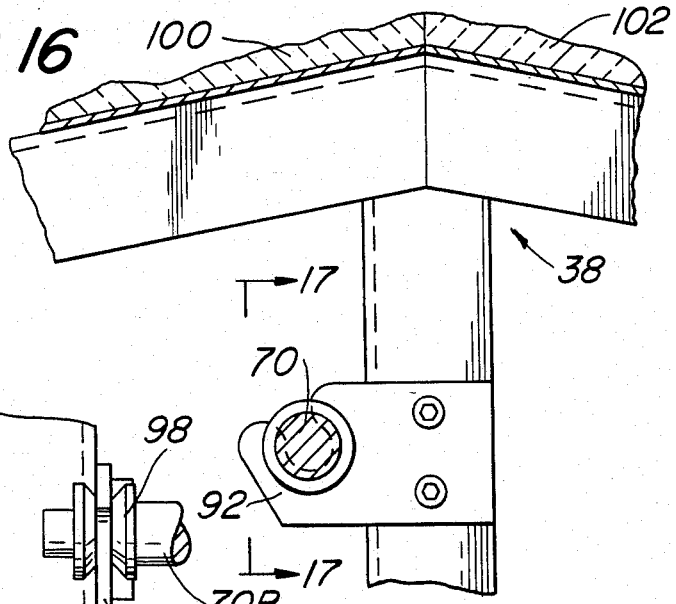
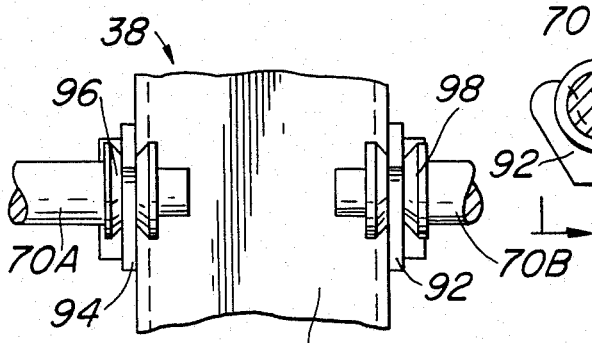
FIG. 17
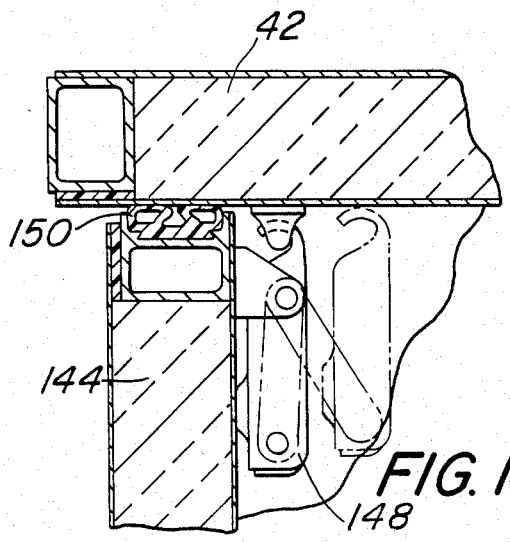
FIG. 18
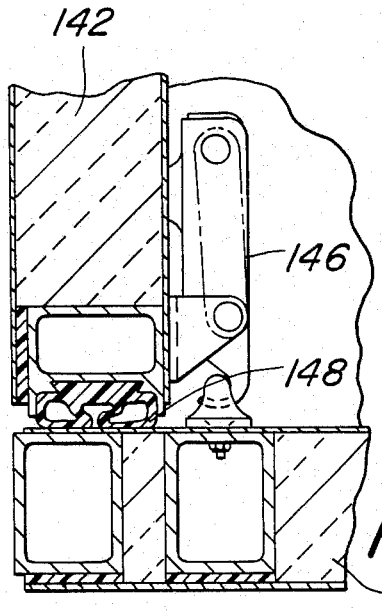
FIG. 19

KNOCK-DOWN EXTENDIBLE SHELTER

BACKGROUND OF THE INVENTION

Extendible shelters have taken various forms. In the main, however, when kits are used, they are connected by conventional permanent fastening means, including nails, nuts and screws and the like. The use of permanent fasteners often make it inconvenient to knock down the shelter for removal to a different site and often result in the loss of some of the parts used to refasten or connect the various parts at a new site.

Other shelters used heretofore have generally not included means for sealing against the weather and other environmental conditions at the joints where the various panels are joined.

Another disadvantage develops in many prior shelters when they have to be built on unlevel ground, which is the normal situation. Unlevel ground poses a number of problems when a number of units have to be added to each other to produce a relatively large shelter.

Most "add on" shelters assembled in the field require special tools, which sometimes are not readily available. Also, indexing and supporting a unit to be added to a prior assembled unit pose special time consuming problems.

Another problem involved in many prior art extendible shelters is that the parts involved are so heavy or cumbersome that they cannot be readily handled by two men, for example.

OBJECTS OF THE INVENTION

It is an object of this invention to provide a novel extendible shelter.

It is a further object of this invention to provide an improved extendible shelter comprising add-on units which are lightweight, and which have high strength and durability.

It is still a further object of this invention to provide an improved extendible shelter kit with high thermal efficiency.

It is still a further object of this invention to provide an improved extendible hard wall shelter kit in which a plurality of modules may be added, dependent upon the size of the shelter, with a minimum use of any loose fastening means, such as screws or nails.

It is still a further object of this invention to provide an improved shelter kit in which a plurality of modules may be added on and in which the individual floors of each added on unit may be independently levelled.

It is still a further object of this invention to provide an improved knock-down and extendible shelter kit with improved water drainage.

It is still a further object of this invention to provide an improved extendible shelter kit in which the units added are self indexing and self supporting.

It is still a further object of this invention to provide an extendible shelter in which the parts involved may be carried and assembled with a minimum number of persons.

BRIEF SUMMARY OF THE INVENTION

In accordance with the present invention, an extendible hard wall shelter comprises a plurality of units joined together. Each unit includes a rigid floor, wall and roof panels. The wall and roof panels are supported on all sides by extruded internal members with full-length hollow gaskets at their mating edges. Metal trusses are used to support a gabled roof and I-beams. Lateral and center cross members, supported on adjustable jacks, form the floor support system. Hinges are attached to the panels to align and fasten each unit as the shelter is being assembled with the gaskets being compressed during assembly to create weather-tight seals and water drainage. The adjustable jacks are attached to the outer corners of the side wall panels and center of the floor joists to provide leveling and vertical support. Captive nuts and bolts and latches are used to connect and fasten together the various structural members.

Other objects and advantages of the present invention will be apparent and suggest themselves to those skilled in the art, from a reading of the following specification and claims taken in conjunction with the accompanying drawings.

BRIEF DESCRIPTION OF THE DRAWINGS

FIG. 16 is a view taken along lines 16—16 of FIG. 1 showing the ridge spacer member used to position the roof truss relative to the proceding truss;

FIG. 17 is a view taken along line 17—17 of FIG. 16 showing the mounting of the ridge spacer using captive bolts;

FIG. 18 is a cross-sectional view illustrating an end wall to side wall connection taken along lines 18—18 of FIG. 1 using an over center locking device;

FIG. 19 illustrates an end wall to side wall connection taken along lines 19—19 of FIG. 1 using an over center locking device;

DESCRIPTION OF THE INVENTION

Figure 1:
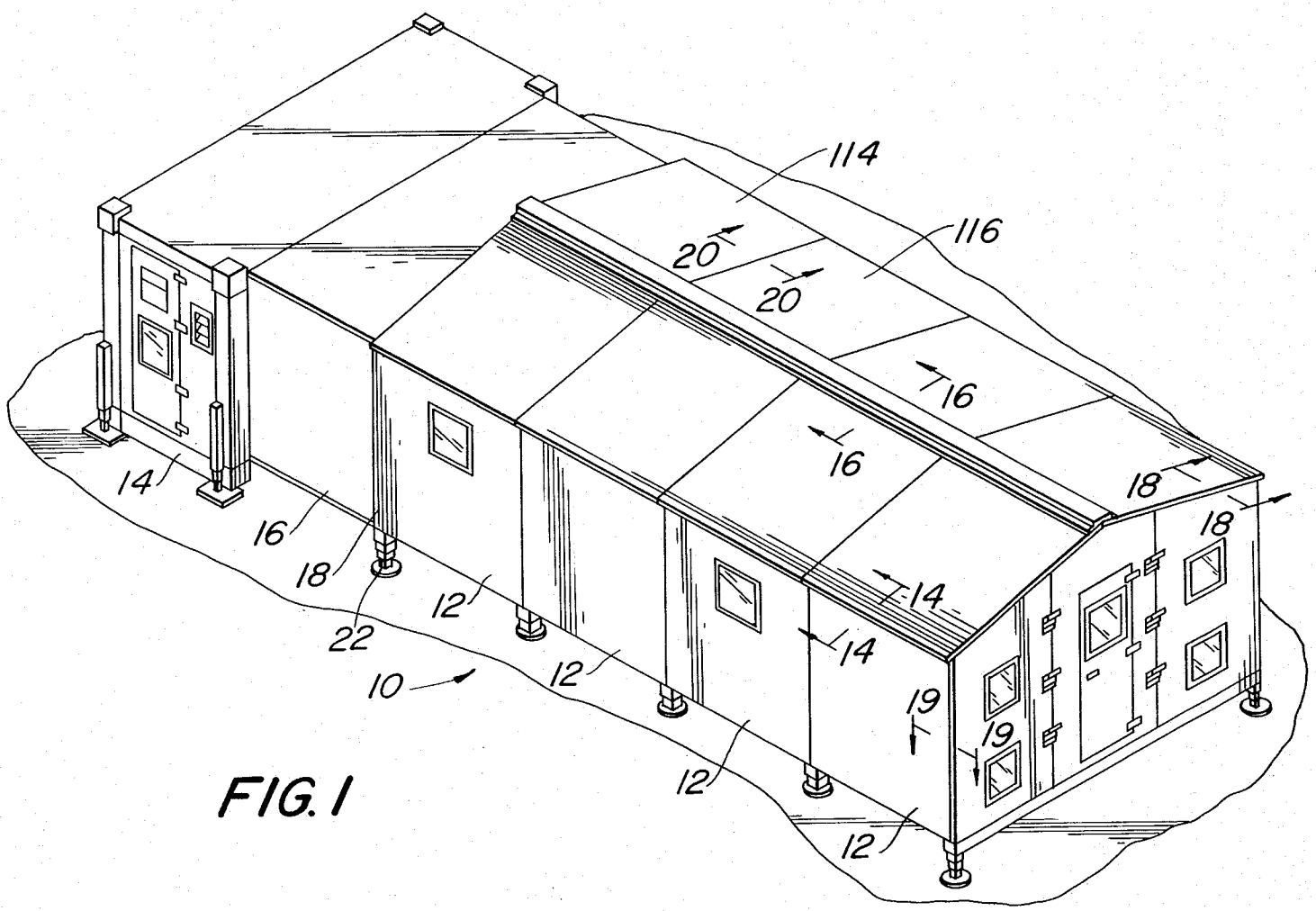
FIG. 1 illustrates a knock-down extendible shelter, in accordance with the present invention.
Figures 2, 3, 4:
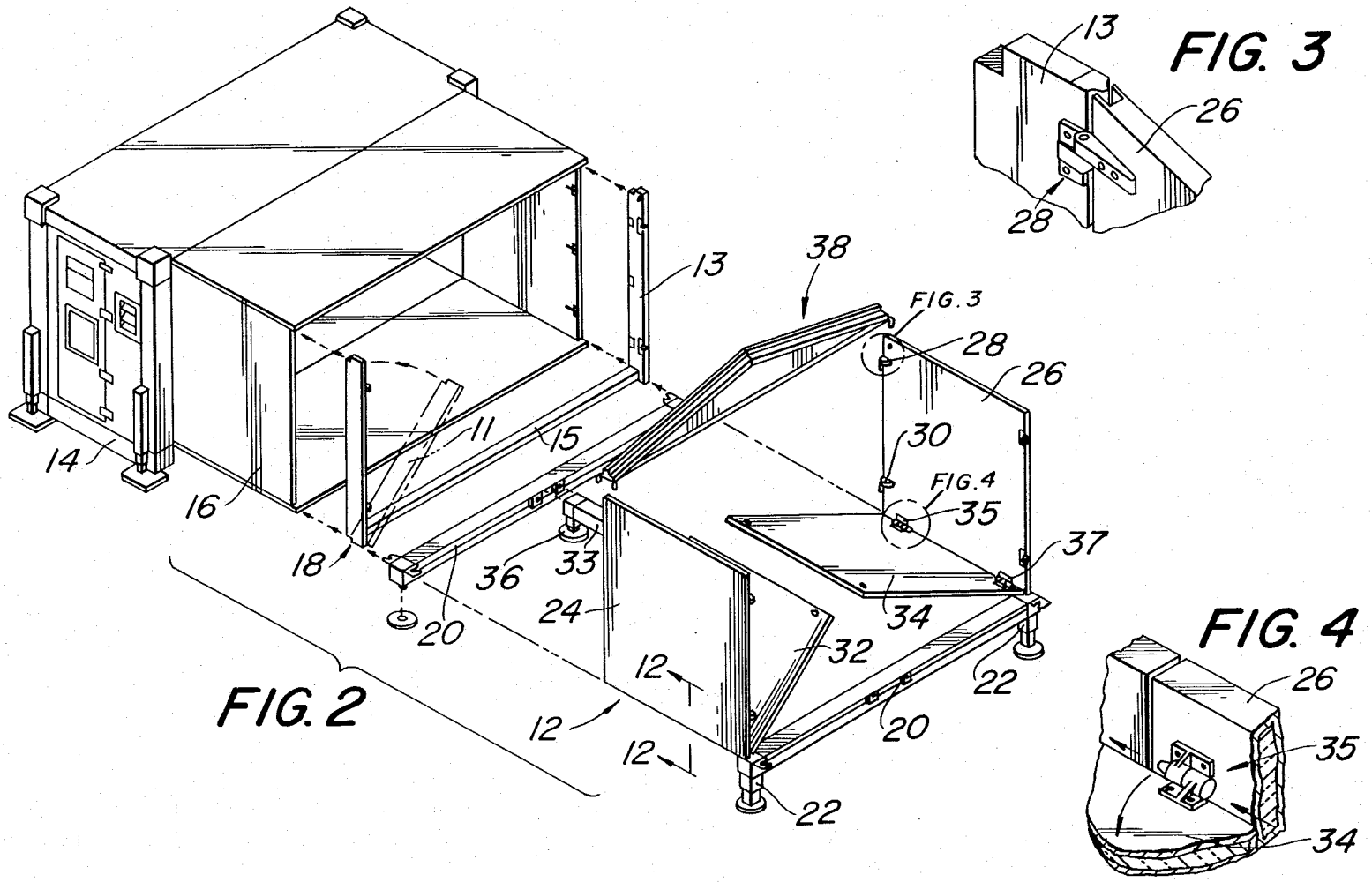
FIG. 2 is an exploded view illustrating the initial steps to be taken toward assembling or building the shelter illustrated in FIG. 1.
FIG. 3 is an enlarged view of a portion in a circle entitled "FIG. 3" in FIG. 2, in which a hinge for joining adjacent wall panels is illustrated.
FIG. 4 is an enlarged view of a portion in a circle entitled "FIG. 4" in FIG. 3, in which a hinge for joining a wall panel to a floor panel is illustrated.

Referring to FIGS. 1 and 2, a shelter or housing 10 comprises a plurality of modular units 12 all including basically the same parts. In the embodiment illustrated, it is assumed that the housing 10 is to be added on to an existing unit 14 or to units 14 and 16 combined. In order to provide a proper interface, a special adapter section 18 is provided. After the adapter 18 has been added onto the unit 16, the subsequent modular units 12 may be assembled to provide the desired building, with the total number of modules added being dependent upon the size of the shelter desired.

The adapter 18 is built to interface with unit 16. The adapter 18 may include hinged members 11 and 13 connected to a cross beam 15. The members 11 and 13 are disposed to be moved into vertical positions with the horizontal beam 15. The adapter 18 provides the interface to the proposed modular add-on connections at the roof, side and floor. It also provides for sealing to the base line unit.

The adapter interface 18 is secured to the deployed unit 16 by existing latches which hold the adapter section 18 in place. The adapter section also includes the interface for the basic module 12.

Figure 6:
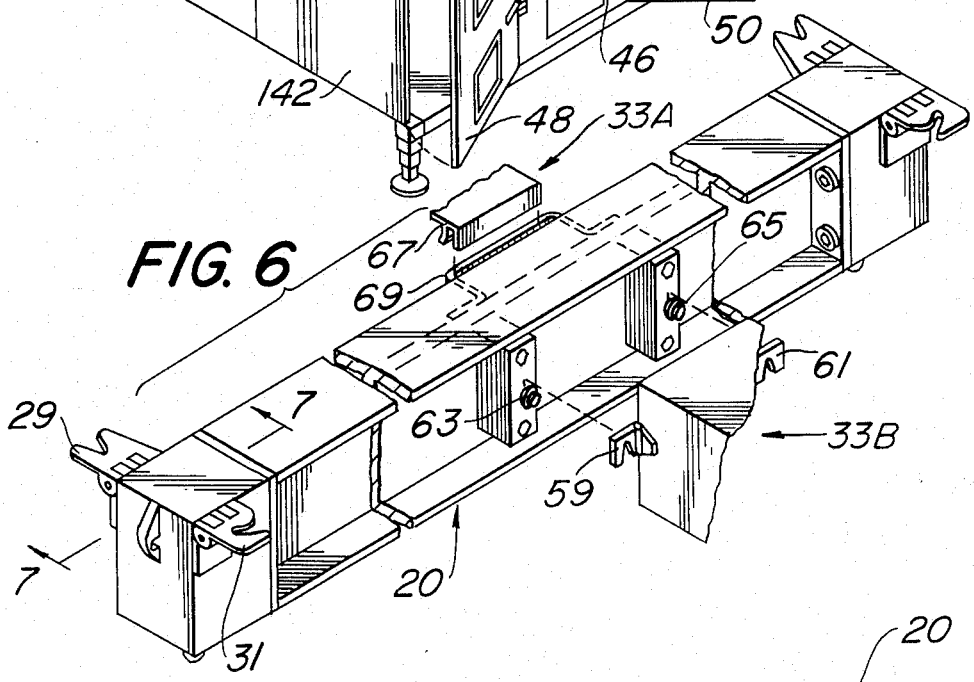
FIG. 6 is an isometric view of a lateral floor beam and center floor beams used to support adjacent units in forming the shelter illustrated in FIG. 1.
Figure 7:
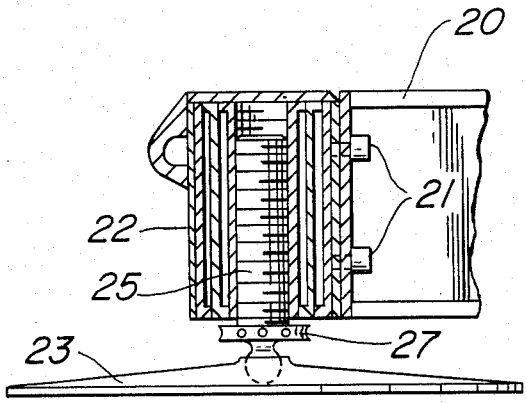
FIG. 7 is a view, partly in cross-section, of a jack connected to a lateral floor beam, which is used for levelling a floor.

A floor or platform support or floor beam 20 (FIGS. 1, 2 and 6) is a common element which is used for supporting all the add on units. The platform support member 20 comprises an aluminum "I" beam which has rigidly connected telescoping jacks 22 on each end (FIGS. 1, 6 and 7). The "I" beam 20 is connected to the jack 22 by fastening bolts 21. The jack 22 includes a stand 23 and a screw 25 connected to an adjustable element 27 which may be turned to vary the height of the floor on the beam 20.

The platform support 20 (FIG. 6) includes attachment elements 29 and 31 to be attached to the adapter interface unit 18 (or to a previous add-on unit) to support the deployable shelter floor of the module 16 as well as the first floor section of the add-on unit 12. After the adapter 18 and telescoping jacks 20 on both sides of the shelter are in place and levelled, units 12 are added on in sequentially the same manner. The units 12 are assembled to each other in the same way that the first unit 12 is assembled to the adapter interface 18.

Referring to FIG. 2, the installation of one of the identical repetitive units 12 is illustrated. Two side panels 24 and 26 are attached to the previous wall panel or the adapter unit 18 by hinges 28 and 30 on side panel 26 and the adapter unit 18. FIG. 3 illustrates the side panel 26 connected to an adapted beam 13 by the hinge 28.

Figure 9:
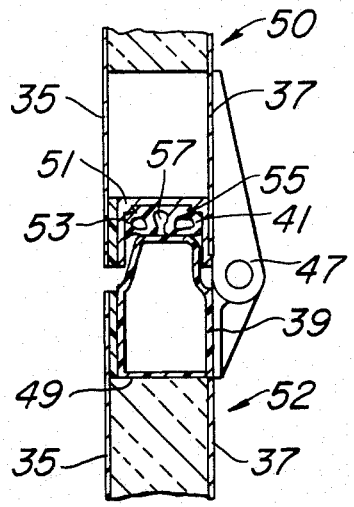
FIG. 9 is a cross-sectional view taken along lines 9—9 of FIG. 8.
Figure 8:
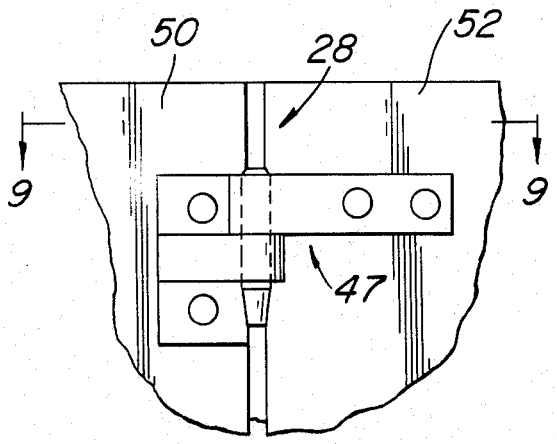
FIG. 8 is an enlarged view illustrating the hinge arrangement for connecting wall-to-wall panels.

FIGS. 8 and 9 illustrate connections of a pair of panels which may be located toward the end of the shelter, for example. The connections are the same as the panel 26 to the adapter unit in FIG. 1. The side panels 50 and 52 are attached to a hinge 47 by dropping the hinge pin into the sockets while holding one panel at an angle with respect to the panel already fixed in position. After hinging, one of the wall panels 52 is swung outwardly which provides sufficient leverage to form a seal, as illustrated in FIG. 9. The panels 50 and 52, as do most of the panels forming the shelter, include inner and outer aluminum skins 35 and 37. Channels 49 and 51 are connected between the aluminum skins and around the four sides of the panels 50 and 52 to receive full length hollow gaskets 39 and 41 at their mating edges. The gasket 41 includes two hollow sections 53 and 55 with a drainage space 57 therebetween in case water passes one of the sections. After the panels 50 and 52 are in place, they are attached to floor beams 20 by captive bolts at the bottom of the panels, which are tightened and connected to gaskets 39 and 41 (FIG. 6) of the floor beams.

Center beams 33, with adjustable jacks 36, are placed longitudinally at the center between the side walls to receive the floor panels thereon, after the side panels are in place.

Referring again to FIG. 2, hinges 35 and 37 are connected between the side walls 24, 26 and the floor panels 32, 34, respectively. When the floor 24 is lowered, it lies flat on the center beam 33. The hinging action provides force for a good seal between the side and floor panels.

Figure 12:
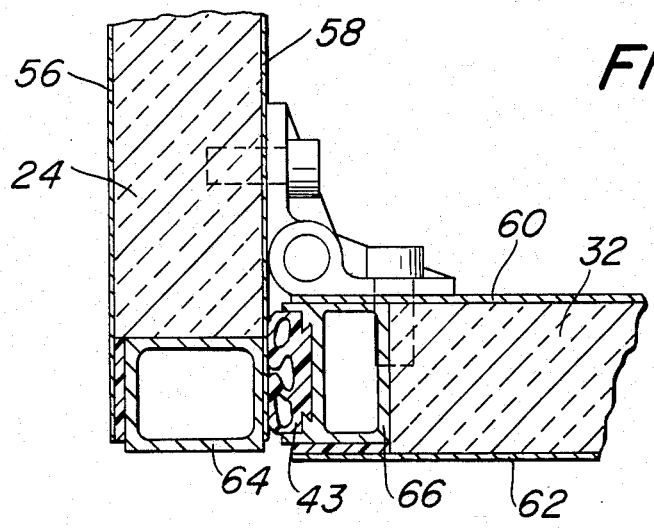
FIG. 12 is a cross-sectional view illustrating a side wall to floor connection.

As illustrated in FIG. 12, each of the panels 24 and 32 also have aluminum skins 56, 58 and 60, 62 on opposite sides thereof. The cores of the panels may be wood or other suitable material. The panels 24 and 32 include channel members 64 and 66 between the ends of the aluminum skins. The panel 32 includes a gasket 43 in the channel which sealingly engages the panel 24. The gasket 43 is similar to gasket 41. When the second floor panel 34 is lowered, it forms a seal with the side panel 26 in the same manner as the seal between the panels 24 and 32.

Figure 13:
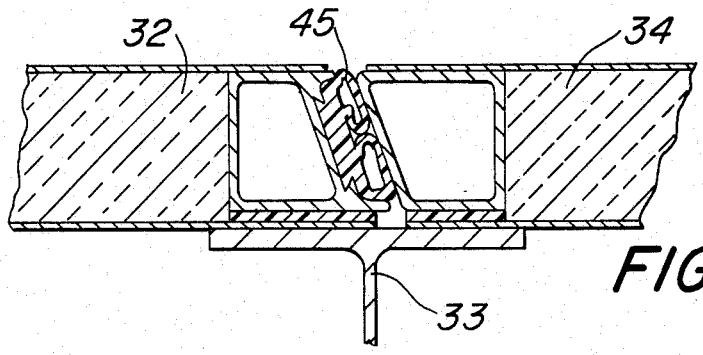
FIG. 13 is a cross-sectional view taken along lines 13—13 of FIG. 10 showing the transverse joint between adjacent floor panels.

A floor-to-floor seal is formed between panels 32 and 34 in a manner illustrated in FIG. 13 which illustrates the floor 34 engaging a gasket 45. Again, the panels include inner and outer aluminum skins and channels disposed at the edges of the panels between the skins.

After floor panels 32 and 34 have been lowered, they are pinned to the center "I" beam floor panels 32 and 34 by captive bolts, not illustrated. Adjustment of the center jacks 36 may be made available from inside the shelter to a sealed access hole into which may be attached an extended Allen wrench.

Figure 10:
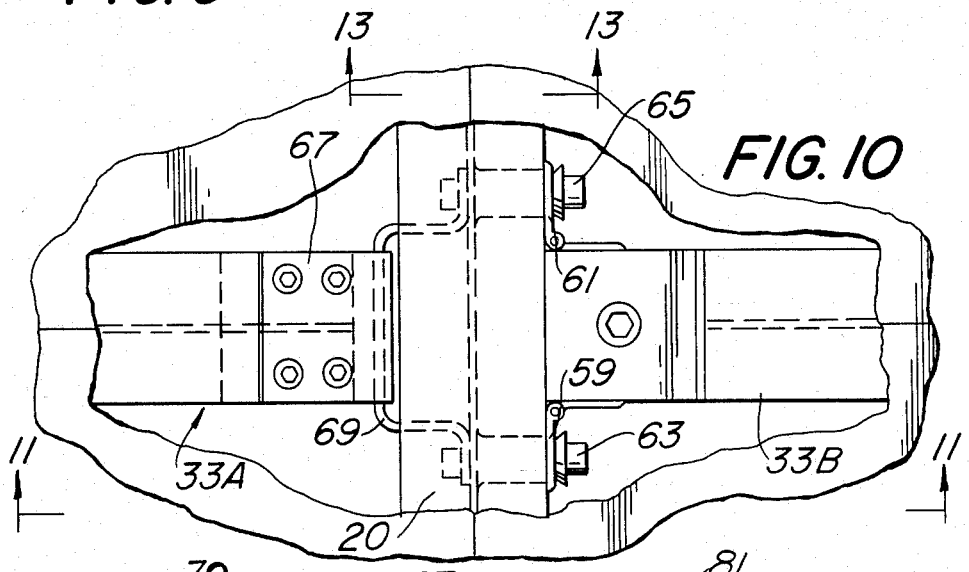
FIG. 10 illustrates the main floor beam connection to the center of a center jack.
Figure 11:
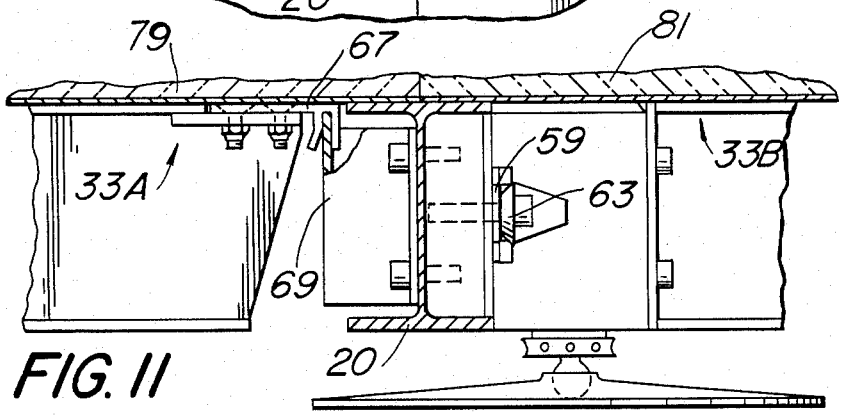
FIG. 11 is a view taken along lines 11—11 of FIG. 10 showing the center jack and center beam attachments.

Referring to FIGS. 6, 10 and 11, a cross beam 20 is illustrated with two center beams 33A and 33B. As mentioned, the previously installed cross beam 20 is positioned to receive two sequentially added adjacent floor panels thereon. Before the floor panels from a single added unit can be lowered, however, the center beam must be in place, which requires that it be connected between two cross beams. Each of a pair of floor panels lowered from their respective side panels eventually rest on two cross beams and one center beam.

The end of the center beam 33B includes a pair of hinged hook-like projections 59 and 61 disposed to be received by a pair of captive bolts 63 and 65 conencted to the cross beam 20. The other end of the center beam 33B is the same as beam 33A and connected to a cross beam. The end of the center beam 33A, illustrated on the opposite side of the cross beam 20 in FIG. 6, includes a curved fitting 67 disposed to hook over and rest on a channel support 69 connected to the cross beam 20.

FIG. 11 illustrates a pair of floor panels 79 and 91 resting on the cross beam support 20 and the center beam supports 33A and 33B.

Figure 5:
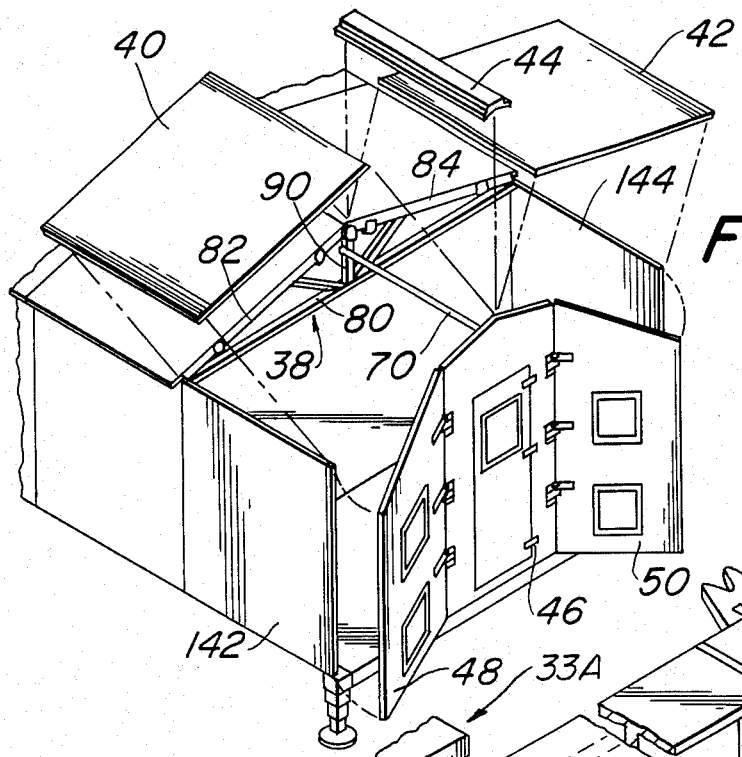
FIG. 5 is an exploded view illustrating the end wall and final steps taken for building the shelter illustrated in FIG. 1.
Figure 14:
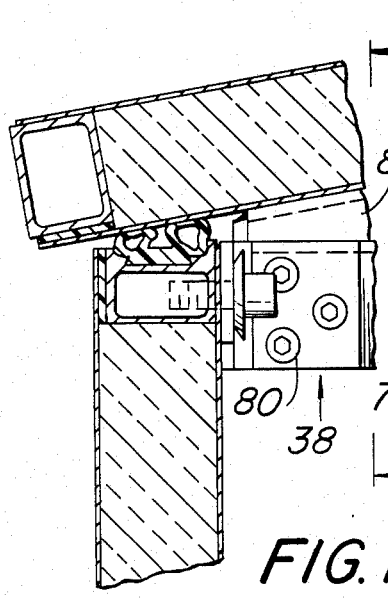
FIG. 14 is a cross-sectional view illustrating a roof to side panel connection taken along lines 14—14 of FIG. 1.
Figure 15:
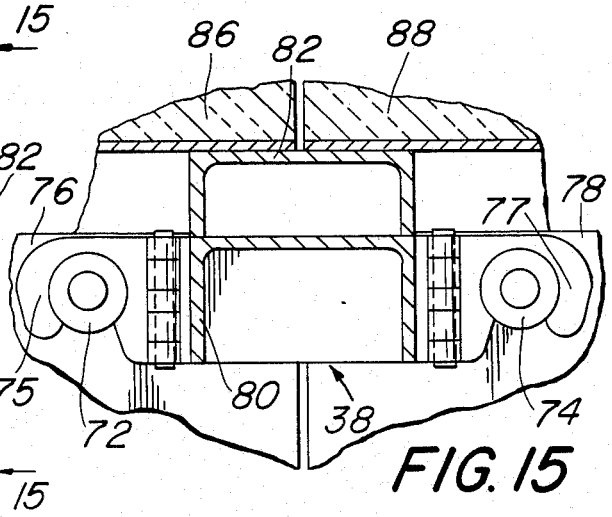
FIG. 15 is a cross-sectional view taken along lines 15—15 of FIG. 14 showing attachment of the roof truss to side panels.

Referring to FIGS. 5, 14 and 15, the truss 38 includes a horizontal beam 80 and angularly upwards projecting joined beams 82 and 84. Hinged hook members 75 and 77 on the ends of the truss beam 80 are received by captive bolts 72 and 74 located in the side panel top corners 76 and 78. This conenction joins two adjacent panels.

FIGS. 14 and 15 illustrate the connections of the truss adjacent side walls and the roof to side wall connection. Before the roof is installed, a ridge spacer bar or tie rod 70 (FIG. 5) is attached between two adjacent trusses 38. The truss 38 (FIG. 5) includes center posts 90 to receive the spacer bars 70 thereon.

FIGS. 16 and 17 illustrate the connections of the spacer bars 70A and 70B to the truss 38. The center post 90 of the truss 38 receive attachment member 92 and 94. The ends of the ridge spacer bars 70A and 70B include captive bolts 96 and 98 disposed to fit into the curved or hook-like portions of attachment elements 92 and 94. Roof panels 100 and 102 rest on the truss 38.

Figure 21:
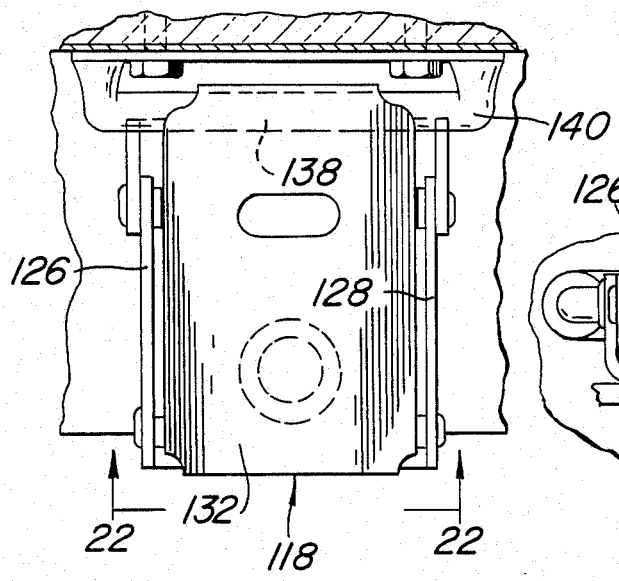
FIG. 21 illustrates the roof panel latch arrangement showing the over center locking device.
Figure 22:
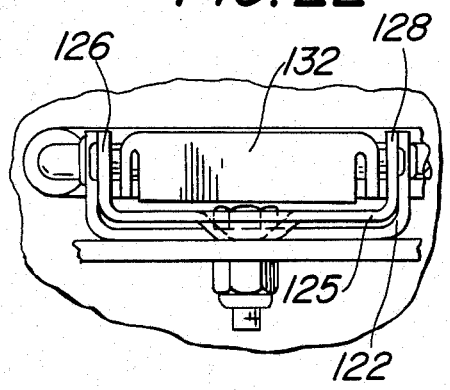
FIG. 22 is a view taken along lines 22—22 of FIG. 21, showing the over center locking device.

The roof panels 114 and 116 (FIGS. 1 and 20) are latched to the roof truss by over the center latch mechanisms 118 and 120 also illustrated in FIGS. 21 and 22. The latches provide the sealing force to complete the roof to roof seal, as illustrated in FIG. 20.

Figure 20:
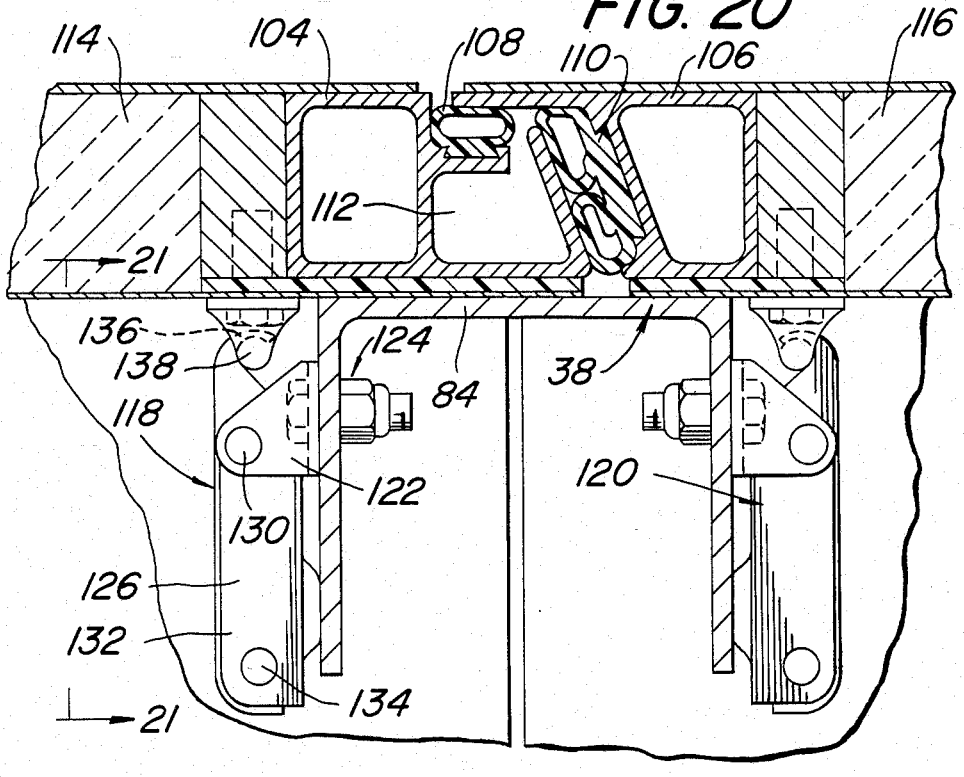
FIG. 20 is a cross-sectional view illustrating a roof-to-roof connection taken along lines 20—20 of FIG. 1 showing the method of sealing and joining the transverse roof joints.

Two joined roof panels are illustrated in FIGS. 5 and 20. The edges of the panels include channels 104 and 106 including gaskets 108 and 110 therein. An open space 112 in the channel 104 between the two gaskets 108 and 110 forms a nautral drain and insures that if any water leaks pass the single gasket 108, it will be automatically channeled to the outside. A secondary double sealing provided by gasket 110 insures that the interior shelter volume is sealed from the outside.

A peak cap 44 (FIG. 5) is added to insure a leak proof seal at the peak of the roof.

Referring to FIGS. 20, 21 and 22, over-the-center latch mechanisms 118 and 120 are connected to one angular beam section 84 of the truss 84. Only the mechanism 118 will be generally described. The latch 118 includes an attachment element 122 secured to the truss 38 by a nut and bolt arrangement 124. A "U" shaped plate 125 includes a pair of side elements 126 and 128 which is pivotally mounted to the attachment element 122 by means of a pin 130. A manually movable plate 132 is movably mounted to the side elements 126 and 128 by means of a pivot pin 134. The plate 132 includes a curved portion 136 disposed to engage a section 138 to a handle-like member 140 secured to the roof panel 114. The plate 132 is adapted to be manually gripped and moved about the pivot pins 130 and 134. When the latch 118 is installed, the hook portion 136 grips the member 14. Continued movement of the plate 132 causes the pin 134 to move pass the center of the pin 130, with a resulting force holding the latch in a locked position.

The attachment of the end wall is illustrated in FIGS. 5, 18 and 19. The center end wall section 46 is hinged to the floor panels in much the same manner as the side walls. Upon rotating the center end wall section to the vertical position, a seal is developed between the center wall and floor. The last ridge space bar 70 is then installed which stabilizes the center end wall section. The two side end wall panels 48 and 50 are the hinged to the center panel 46. The panels 48 and 50 are then moved into contact with side walls 142 and 144.

A latch 146 of the type described in connection with FIGS. 21 and 22 are used to secure the side wall 142 to the front wall 48. A seal between the side and end walls is provided by as gasket 148 illustrated in FIG. 19. Finally, the last roof panels 40 and 42 are attached to the trusses. Again latches, such as latch 148, are provided to provide the seal, with a gasket 150 between the end side wall 144 and roof 42 being provided as illustrated in FIG. 18.

The area relating to the first truss area over the first unit 12 and unit 16 may include shortened portions connected in a similar manner to the end wall.

What is claimed is:

1. An extendible shelter comprising:

(a) a plurality of similar units each including floor, side wall and roof panels;

(b) hinge members for connecting said side wall panels to previously assembled wall panels as units are added;

(c) second hinge members for connecting a pair of wall panels to a pair of floor panels in the same unit;

(d) a support beam for supporting said floor panels;

(e) truss members connected to adjacent assembled wall panels; and (f) means for connecting said roof panels to said truss members;

(g) flexible gaskets including open areas disposed within said gaskets to permit water drainage disposed around said panels and between adjacent panels when said shelter is assembled;

(h) lateral support beams connected to adjustable jacks to permit leveling of said floor panels;

(i) each said lateral support beams supporting floor panels of two adjacent units;

(j) each of said units including a pair of floor panels extending outwardly from a pair of said side wall panels towards a center of said extendible shelter;

(k) center support beams connected to adjustable jacks centrally disposed along said shelter to support a pair of floor panels in said units, and (l) locking mechanism including latches to lock said floor panels to said lateral and center support beams.

2. An extendible shelter as set forth in claim 1 wherein second locking mechanisms are provided to lock said truss members to the tops of said side wall panels.

3. An extendible shelter as set forth in claim 2 wherein latching mechanisms are provided to fasten said truss members to said side wall panels.

4. An extendible shelter as set forth in claim 3 wherein an end wall comprising two end side panels hinged to a center end wall panel is provided to close the last assembled unit to said extendible shelter and said end wall panel being hinged to last floor panels in said shelter.

5. An extendible shelter as set forth in claim 4 wherein said two end side panels are latched to opposite wall panels in said last assembled unit.

6. An extendible shelter as set forth in claim 5 wherein an adapter assembly adapted to receive a first add-on unit is connected to an existing building.

* * * * *